United States Patent [19]

Lindström

[11] Patent Number: 4,808,310

[45] Date of Patent: Feb. 28, 1989

[54] APPARATUS FOR LIQUID TREATMENT OF PULP WITH VAPOR SEPARATION

[75] Inventor: Alf I. Lindström, Sundsbruk, Sweden

[73] Assignee: Sunds Defibrator Aktiebolag, Sweden

[21] Appl. No.: 124,939

[22] PCT Filed: Apr. 1, 1987

[86] PCT No.: PCT/SE87/00168

§ 371 Date: Nov. 13, 1987

§ 102(e) Date: Nov. 13, 1987

[87] PCT Pub. No.: WO87/06281

PCT Pub. Date: Oct. 22, 1987

[30] Foreign Application Priority Data

Apr. 8, 1986 [SE] Sweden ..... 8601568

[51] Int. Cl.[4] ..... D21C 9/06

[52] U.S. Cl. ..... 210/401; 68/181 R; 162/60; 210/406; 210/416.1

[58] Field of Search ..... 162/60, 308, 381; 8/156; 210/400, 401, 406, 416.1; 68/205 R, 181 R

[56] References Cited

U.S. PATENT DOCUMENTS

| | | | |
|---|---|---|---|
| 2,237,635 | 4/1941 | Saxe | 210/400 |
| 4,154,644 | 5/1979 | Ericsson | 162/60 |
| 4,161,395 | 7/1979 | Brown et al. | 210/401 |
| 4,569,762 | 2/1986 | Gaudrin | 210/401 |
| 4,657,637 | 4/1987 | Lindstrom | 162/272 |

*Primary Examiner*—Kenneth M. Schor
*Assistant Examiner*—K. M. Hastings
*Attorney, Agent, or Firm*—Lerner, David, Littenberg, Krumholz & Mentlik

[57] ABSTRACT

An apparatus having a liquid-permeable belt for receiving cellulose pulp, a liquid supply device for discharging treatment liquid on the cellulose pulp, and a container extending across the entire width of the belt for collecting treatment liquid penetrating the belt. The container is adapted to maintain a treatment liquid level at such a distance from the belt so that the formation of foam from treatment liquid is reduced. The container includes a liquid outlet for discharging the treatment liquid and a vapour outlet for discharging vapours and gases from the bottom of the container. The vapour outlet communicates with a passageway within the container, which passageway is formed as a pipe or is partially defined by a container wall. A deflector can be provided on the container for operatively deflecting treatment liquid away from the passageway.

7 Claims, 3 Drawing Sheets

APPARATUS FOR LIQUID TREATMENT OF PULP WITH VAPOR SEPARATION

BACKGROUND OF THE INVENTION

This invention relates generally to an apparatus for the liquid treatment of pulp, and more specifically to a liquid treatment system where vapour and liquid are discharged separately.

This invention relates to an apparatus for the liquid treatment of pulp, comprising a stand with two end rolls, over which an endless liquid permeable web runs. The web consists of a wire or perforated belt, for example steel belt. The web is driven by one of the end rolls and slides over perforated covers on containers located therebeneath. A head box for the supply of pulp is located at one end of the web, and means for the transfer of the treated pulp are located at the other end of the web. Means for supplying treatment liquid to the pulp are located above the web. The containers located beneath are intended for the collection of liquid.

The said containers extend in cross-direction along the entire width of the web and are arranged one after the other in the running direction of the web. The width of the web, and therewith also of the containers, can be up to 6 m. In certain cases webs of still greater width are used. The containers may also be sections of a greater trough.

At the liquid treatment liquid in the pulp is driven out by supplied treatment liquid. The liquid driven out together with vapours and gases are collected in the containers.

It is desired to discharge vapours and liquid from the containers separately. This, however, involves difficulties, due to the extension of the containers in the cross-direction of the web and to the restricted space in the containers, which implies that the flow rate of the vapours is high and foam formation easily arises.

The present invention has the object to solve this problem. According to the invention, a very compact structural design in combination with low vapour rate and reduced risk of foam formation in the containers is obtained. The characterizing features of the invention are apparent from the attached claims.

BRIEF DESCRIPTION OF THE DRAWING

The invention is described in greater detail in the following, with reference to the accompanying Figures showing a preferred embodiment of the invention.

DESCRIPTION OF THE INVENTION

Figure 1:
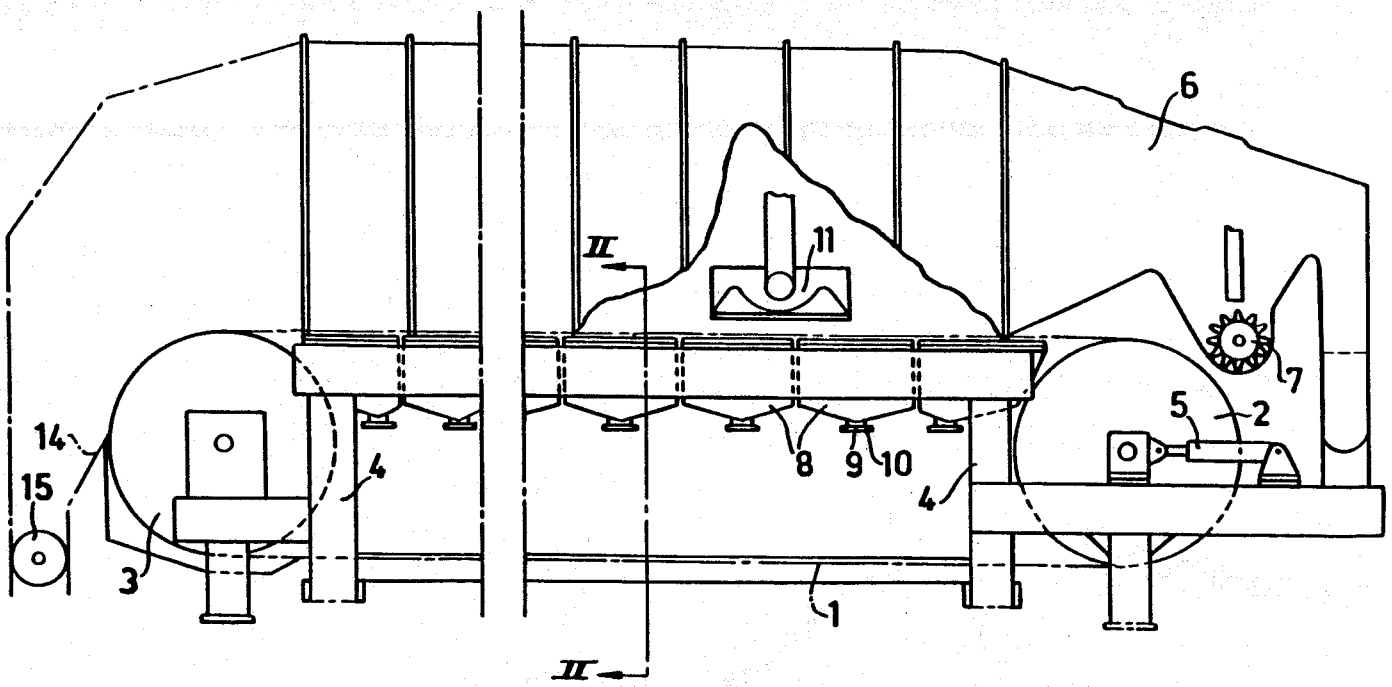
FIG. 1 shows a liquid treatment system according to the invention.

The embodiments shown comprise an endless perforated steel belt 1, which runs about a first and a second end roll 2 and, respectively, 3. The rolls are arranged in a stand 4. The first roll 2 is movable by means of a stretching device, preferably hydraulic, for adjusting the belt tension. The belt is driven via the second roll 3, and both rolls are preferably coated with a friction increasing surface layer.

At the first roll 2 a head box 6 is located for distributing the cellulose pulp to a uniform layer on the belt 1.

After the head box 6 a plurality of containers 8 are arranged one after the other in the longitudinal direction of the belt. The containers 8 are provided with perforated covers as a support for the belt 1. Outlets 9 and, respectively, 10 are connected to the containers 8 for the removal of liquid and, respectively, vapours and gases. The liquid outlet is located in the bottom of the containers 8 to ensure effective drainage. The liquid level in the containers is controlled by special means so that a small space for vapours and gases is maintained in the upper portion. The fall of the liquid from the belt 1 down into the containers thereby is small and reduces the foaming tendency.

The outlet 10 for vapours and gases also is located in the bottom of the containers 8, preferably centrally beneath the containers in the cross-direction of the belt. The structural design, however, renders their location possible anywhere in the cross-direction of the containers.

The outlet communicates with the space for vapours and gases in the containers 8 through an internal passageway 21. A deflector 22 co-operates with said passageway and prevents liquid from the belt 1 to flow down into the outlet 10. Several outlets for vapour and gas may possibly be arranged beneath the containers, in which case they are placed in spaced relationship along the containers. Hereby the vapour and gas flow along the containers can be minimized and the gas rate be reduced so that a substantially laminar flow is obtained, which implies that liquid is not taken along and foaming is avoided. An effective separation of vapours and gases is hereby obtained in the containers. Due to the design, the containers can be utilized at maximum in their entire length in the cross-direction of the belt.

Figure 2:
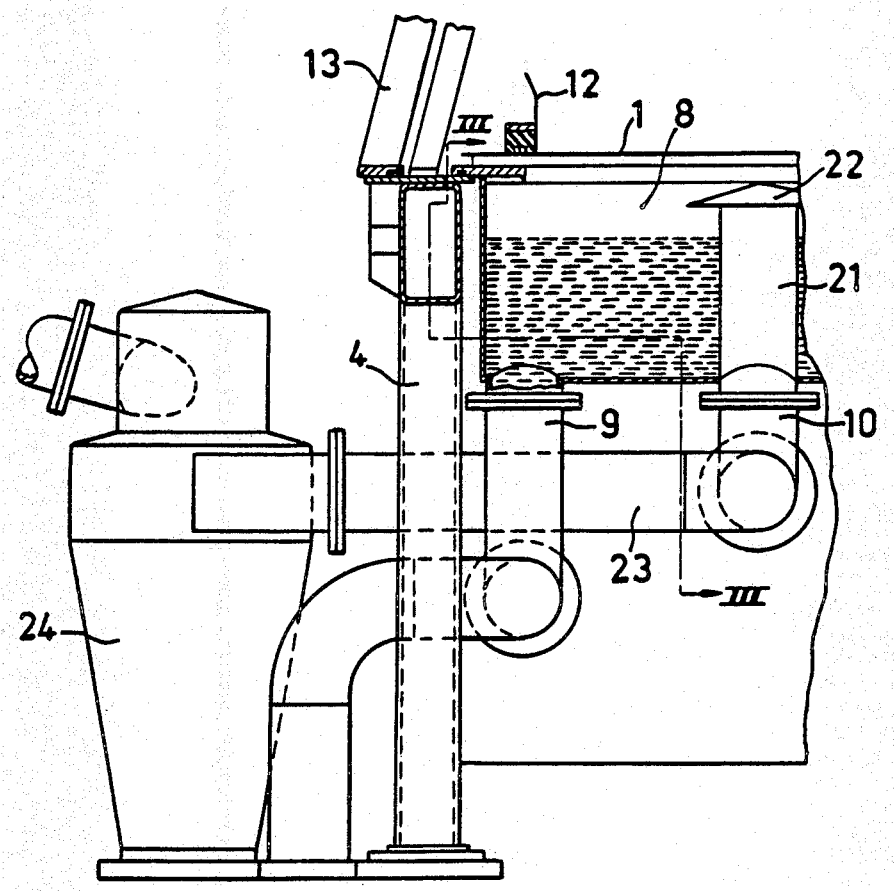
FIG. 2 shows a portion of a cross-section along II—II in FIG. 1.
Figure 3:
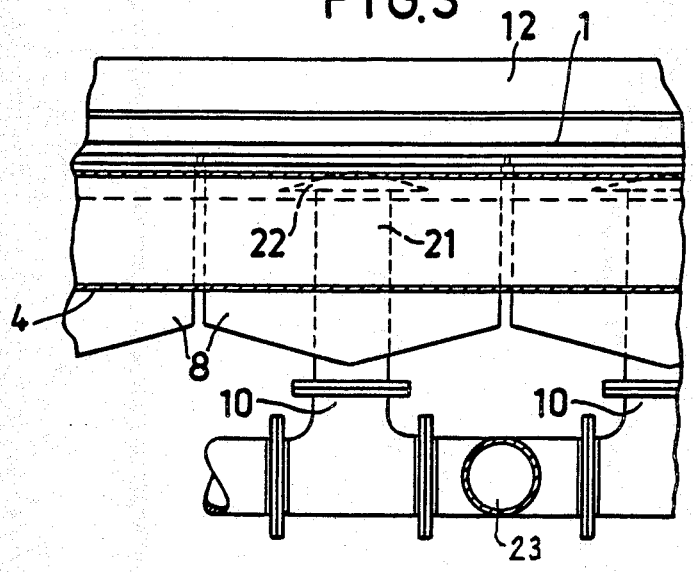
FIG. 3 is a section along III—III in FIG. 2.

According to the embodiment shown in FIGS. 2 and 3, the passageway 21 is formed as a pipe, on which the deflector 22 is attached. The passageway, however, can be formed in a different way, and the screening can be arranged, for example, in the walls or cover of the container.

Figure 4:
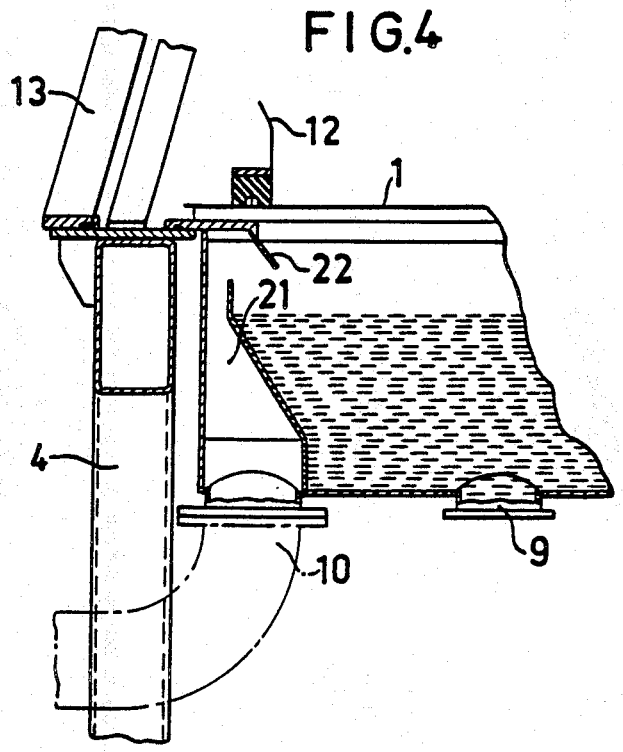
FIG. 4 shows a second embodiment in a section along II—II in FIG. 1.

According to the embodiment shown in FIG. 4, the passageway 21 is defined by a wall element and the deflector 22 located in the cover of the container 8.

The outlet 10 for vapours and gases communicates with a suitable exhausting device, for example a fan, whereby vapours and gases can be discharged directly or via a collecting vessel for liquid. In order to additionally improve the separation of vapours and gases, the outlets 10 from the containers 8 can be connected to a cyclone 24 via a conduit 23. The cyclone 24 is located to the side of the belt 1 on the same level as the outlets 10.

Above the belt 1 devices 11 for the supply of treatment liquid are arranged. A pressure difference is maintained above the pulp layer in order to effect liquid transport transversely through the pulp layer. The width of the pulp layer on the belt is limited by means 12. A hood 13 is placed over the belt.

At the second roll 3 a transfer device 14 for the completely treated pulp layer is located, which, for example, has the form of a doctor blade. Below said blade a feed screw 15 is located for transporting the pulp to subsequent processing steps.

The steel belt used preferably shall have a thickness of 0.5–1.5 mm. The diameter of the end rolls must be adapted to the belt thickness, because the bending stress in the belt is directly proportional to the belt thickness and reciprocally proportional to the roll diameter. A suitable dimension of the rolls can be about 2 m diameter. The aperture size must be adapted to the pulp to be treated, but should be in the interval of 0.5–1.5 mm diameter. It can, of course, also be imagined to design the apertures as slits. The open area under all conditions must be between 8 and 25%.

The length and width of the belt are not critical, but can be chosen at option. The width desired can be obtained by longitudinally welding a number of narrow belts to a wider one, because it is not possible to directly manufacture steel belts of the widths required, which are, for example, about 6 m or wider. Steel belts normally are not manufactured with widths exceeding slightly one meter.

The invention is not restricted to the embodiments shown, but can be varied within the scope of the invention idea.

I claim:

1. Apparatus for the liquid treatment of a pulp suspension, comprising a liquid-permeable belt for receiving said pulp suspension, said belt having a longitudinal axis and including an upper surface and a lower surface, treatment liquid supply means for supplying treatment liquid onto said upper surface of said belt, at least one container defined by outer container walls and having a bottom and being arranged at said lower surface of said belt for collecting liquid penetrating said belt, whereby a liquid level is maintained within said at least one container, said at least one container extending transversely of said longitudinal axis of said belt and across substantially the entire width thereof, said at least one container further including a liquid outlet for discharging said liquid from said at least one container, a vapour outlet located at the bottom of said at least one container for discharging vapours generated within said at least one container therefrom and an internal passageway extending from said vapour outlet to a predetermined location at an upper portion of said at least one container above said liquid level within said at least one container for discharging said vapours therefrom, said internal passageway being partially defined by at least one of said outer container walls.

2. Apparatus for the liquid treatment of a pulp suspension as claimed in claim 1, wherein said at least one container includes deflector means operatively associated with said internal passageway to prevent said liquid within said at least one container from entering said internal passageway.

3. Apparatus for the liquid treatment of a pulp suspension as claimed in claim 1, including carrying means for carrying away from said container said vapours and gases discharged from said vapour outlet, said carrying means being situated parallel to the longitudinal axis of said belt and substantially within the width thereof.

4. Apparatus for the liquid treatment of a pulp suspension as claimed in claim 1, including a plurality of said containers spaced along said belt.

5. Apparatus for the liquid treatment of a pulp suspension as claimed in claim 1, including cyclone means for separating any liquid from said vapours, and cyclone connection means for connecting said vapour outlets to said cyclone, said cyclone connection means extending substantially horiznontally and at substantially the same level as said vapour outlet.

6. Apparatus for the liquid treatment of a pulp suspension as claimed in claim 1 wherein a perforated cover is provided for said container.

7. Apparatus for the liquid treatment of a pulp suspension as claimed in claim 6, including a deflector connected to said cover to prevent said liquid penetrating said belt from entering said internal passageway.

* * * * *